US008424441B2

(12) United States Patent
Brittingham et al.

(10) Patent No.: US 8,424,441 B2
(45) Date of Patent: Apr. 23, 2013

(54) FIREARM SUPPRESSOR BOOSTER SYSTEM

(75) Inventors: Kevin Brittingham, Norcross, GA (US); Michael Leighton Smith, Alpharetta, GA (US)

(73) Assignee: Advanced Armament Corp., Madison, NC (US)

( * ) Notice: Subject to any disclaimer, the term of this patent is extended or adjusted under 35 U.S.C. 154(b) by 390 days.

(21) Appl. No.: 12/860,555

(22) Filed: Aug. 20, 2010

(65) Prior Publication Data

US 2011/0088540 A1 Apr. 21, 2011

Related U.S. Application Data

(60) Provisional application No. 61/274,738, filed on Aug. 20, 2009.

(51) Int. Cl.
*F41A 21/38* (2006.01)

(52) U.S. Cl.
USPC ..... 89/14.4; 89/14.5; 181/223

(58) Field of Classification Search ..... 89/14.4, 89/14.5; 181/223
See application file for complete search history.

(56) References Cited

U.S. PATENT DOCUMENTS

| | | | |
|---|---|---|---|
| 785,974 | A | 3/1905 | McClean |
| 863,342 | A | 8/1907 | Alber |
| 1,017,003 | A | 2/1912 | Kenney |
| 1,173,687 | A | 2/1916 | Thompson |
| 1,342,978 | A | 6/1920 | Young |
| 1,413,903 | A | 4/1922 | Czegka |
| 1,462,158 | A | 7/1923 | Wildner |
| 1,525,846 | A | 2/1925 | Wurtzebach |
| 1,605,864 | A | 11/1926 | Steinegger |
| 1,667,186 | A | 4/1928 | Bluehdorn |
| 1,770,471 | A | 7/1930 | Hatcher |
| 1,773,443 | A | 8/1930 | Wilman |
| 2,016,226 | A | 10/1935 | Clausen |

(Continued)

FOREIGN PATENT DOCUMENTS

DE 2229071 11/1973

OTHER PUBLICATIONS

Paulson, et al., Silencer History and Performances, vol. 2 COB, Assault Rifles and Sniper Technology (2002), p. 350, Table 7.3.

(Continued)

*Primary Examiner* — J. Woodrow Eldred
(74) *Attorney, Agent, or Firm* — Womble Carlyle Sandridge & Rice, LLP

(57) ABSTRACT

A booster system including a piston housing, a piston, a spring, and a rear cap attached to the piston housing. The piston housing includes an annular outer wall and an annular projection extending inward from the outer wall at a rear end of the piston housing. The piston is disposed within the piston housing and includes a bore and a radially outwardly extending flange at its front end. The spring is radially disposed between the piston housing and the piston in a space enclosed by the outwardly extending flange and the annular projection. The rear cap includes an end wall extending radially outward from a rear end of the piston housing. A side wall extends forward from the end wall and hangs over the outer wall of the piston housing at a radial distance from the outer wall of the piston housing. The sidewall of the rear cap includes an engagement surface for attachment to a body of a silencer.

18 Claims, 5 Drawing Sheets

U.S. PATENT DOCUMENTS 2,058,897 A 10/1936 Marek
2,124,075 A 7/1938 Moore
2,315,207 A 3/1943 Janecek et al.
D143,022 S 11/1945 Norman
2,503,491 A 4/1950 Janz
2,663,410 A 12/1953 Kessler
2,748,662 A 6/1956 Simpson
2,791,944 A 5/1957 Harvey
2,792,760 A 5/1957 Hammer
2,870,679 A 1/1959 Collins
2,883,781 A 4/1959 Harvey
2,895,383 A 7/1959 Reed
2,900,875 A 8/1959 Fergus et al.
2,941,450 A 6/1960 Ray et al.
3,020,807 A 2/1962 Hailston et al.
3,051,057 A 8/1962 Ivy
3,114,289 A 12/1963 Aulabaugh
3,164,060 A 1/1965 Dahl
3,385,164 A 5/1968 Walther et al.
3,483,794 A 12/1969 Packard
3,500,955 A 3/1970 Werbell
3,667,570 A 6/1972 WerBell, III
3,677,132 A 7/1972 Plenge
3,698,747 A 10/1972 Wing et al.
3,732,776 A 5/1973 Snodgrass
3,744,370 A 7/1973 Snodgrass
3,748,956 A 7/1973 Hubner
3,766,822 A 10/1973 Sophinos
3,786,895 A 1/1974 Perrine
3,888,331 A 6/1975 Wang
3,968,727 A 7/1976 Hyytinen
4,159,552 A 7/1979 Berecz
4,233,737 A 11/1980 Poehlmann
4,291,610 A 9/1981 Waiser
4,384,507 A 5/1983 Finn
4,426,248 A 1/1984 Jackson
4,433,611 A 2/1984 Baumann
4,499,811 A 2/1985 Kaste
4,510,843 A 4/1985 Rabatin
4,530,417 A 7/1985 Daniel
4,570,529 A 2/1986 A'Costa
4,576,083 A 3/1986 Seberger, Jr.
4,579,034 A 4/1986 Holloway
4,584,924 A 4/1986 Taguchi
4,588,043 A 5/1986 Finn
4,599,934 A 7/1986 Palmer
D285,238 S 8/1986 Cellini
4,643,272 A 2/1987 Gaffrig
4,679,597 A 7/1987 Stein
4,702,146 A 10/1987 Ikeda et al.
4,716,809 A 1/1988 A'Costa
4,756,677 A 7/1988 Hribernik et al.
4,785,909 A 11/1988 Young
4,893,544 A 1/1990 Hawley et al.
4,907,488 A 3/1990 Seberger
4,907,489 A 3/1990 Teague
4,930,396 A 6/1990 Johnson
4,939,977 A 7/1990 Stroup
4,971,489 A 11/1990 Womack
4,974,489 A 12/1990 Fishbaugh
5,029,512 A 7/1991 Latka
5,092,223 A 3/1992 Hudson
5,136,924 A 8/1992 Forster et al.
5,140,893 A 8/1992 Leiter
5,164,535 A 11/1992 Leasure
D349,147 S 7/1994 Gwinn, Jr.
5,325,758 A 7/1994 Compton et al.
5,356,183 A 10/1994 Cole
5,438,907 A 8/1995 Reynolds et al.
5,476,026 A 12/1995 McFarlin
5,476,028 A 12/1995 Seberger
5,559,302 A 9/1996 Latka
5,596,161 A 1/1997 Sommers
5,611,409 A 3/1997 Arseneau
5,631,438 A 5/1997 Martel
5,679,916 A 10/1997 Weichert
5,689,907 A 11/1997 Cooley
5,737,835 A 4/1998 Murata
5,773,746 A 6/1998 Vaden
D415,812 S 10/1999 Andrews, Jr. et al.
D415,813 S 10/1999 O'Quinn et al.
5,983,772 A 11/1999 Reynolds et al.
6,026,728 A 2/2000 Gühring et al.
6,079,311 A 6/2000 O'Quinn et al.
D435,884 S 1/2001 Dehaan
6,176,032 B1 1/2001 Cohen et al.
6,289,623 B1 9/2001 Cohen et al.
6,308,609 B1 10/2001 Davies
6,324,780 B1 12/2001 Behling
6,374,718 B1 4/2002 Rescigno et al.
6,385,891 B1 5/2002 Rabatin
6,412,389 B2 7/2002 Fluhr
6,425,310 B1 7/2002 Champion
6,575,074 B1 6/2003 Gaddini
6,595,099 B1 7/2003 Olson et al.
6,701,820 B2 3/2004 Fluhr
6,722,254 B1 4/2004 Davies
6,796,214 B2 9/2004 Hausken et al.
6,796,403 B1 9/2004 Laughlin
6,810,615 B2 11/2004 Hermanson et al.
6,820,530 B2 11/2004 Vais
6,837,139 B2 1/2005 Meyers
6,889,593 B2 5/2005 Gühring et al.
6,905,297 B2 6/2005 DiStasio et al.
6,923,292 B2 8/2005 Woods et al.
6,931,776 B2 8/2005 Wagner et al.
6,948,415 B2 9/2005 Matthews et al.
6,973,863 B1 12/2005 Jones
7,059,235 B2 6/2006 Hanslick et al.
7,062,874 B1 6/2006 Smith
7,073,426 B1 7/2006 White
7,155,143 B2 12/2006 Miner et al.
D542,877 S 5/2007 Murello et al.
7,237,467 B1 7/2007 Melton
7,290,475 B2 11/2007 Fluhr
7,302,774 B2 12/2007 Meyers
7,308,967 B1 12/2007 Hoel et al.
7,325,474 B2 2/2008 Yoshimura et al.
7,353,740 B1 4/2008 Hoffman
7,412,917 B2 8/2008 Vais
D577,409 S 9/2008 Brittingham
D577,410 S 9/2008 Brittingham
D582,502 S 12/2008 Brittingham
D582,503 S 12/2008 Brittingham
D584,786 S 1/2009 Brittingham
D584,787 S 1/2009 Brittingham
D585,518 S 1/2009 Brittingham
D591,382 S 4/2009 Brittingham
7,530,299 B1 5/2009 Poff
D598,066 S 8/2009 Brittingham
7,587,969 B2 9/2009 Silvers
7,588,122 B2 * 9/2009 Brittingham ..... 181/223
7,594,464 B2 9/2009 Dueck
7,600,606 B2 10/2009 Brittingham
7,610,710 B2 11/2009 Brittingham
7,610,992 B2 11/2009 Brittingham
D610,221 S 2/2010 Brittingham
7,661,349 B1 2/2010 Brittingham
7,676,976 B2 3/2010 Dueck et al.
7,677,150 B2 3/2010 Dater et al.
7,743,693 B1 6/2010 Brittingham
7,789,009 B1 9/2010 Brittingham
7,866,079 B2 1/2011 Keeney et al.
7,874,238 B2 1/2011 Silvers
7,891,282 B1 * 2/2011 DeGroat ..... 89/14.4
7,905,170 B1 3/2011 Brittingham et al.
7,905,171 B1 * 3/2011 Brittingham ..... 89/36.08
7,926,404 B2 4/2011 Brittingham
7,987,944 B1 8/2011 Brittingham et al.
8,091,462 B2 1/2012 Dueck et al.
8,156,855 B2 4/2012 Anderson
8,162,100 B2 * 4/2012 Shults et al. ..... 181/223
8,201,487 B2 6/2012 Dueck et al.
8,272,306 B1 9/2012 Smith
2005/0115394 A1 6/2005 Matthews et al.
2005/0126382 A1 6/2005 Yoshimura et al.
2006/0010750 A1 1/2006 Yoshitaka

| | | | |
|---|---|---|---|
| 2006/0060076 | A1 | 3/2006 | Dueck et al. |
| 2006/0243125 | A1 | 11/2006 | La France |
| 2007/0095198 | A1 | 5/2007 | Dater et al. |
| 2007/0107590 | A1 | 5/2007 | Silvers |
| 2007/0137084 | A1 | 6/2007 | Laney et al. |
| 2007/0266844 | A1 | 11/2007 | Dueck |
| 2008/0083321 | A1 | 4/2008 | Dueck et al. |
| 2008/0098880 | A1 | 5/2008 | Brugger |
| 2008/0121096 | A1 | 5/2008 | Hajjar et al. |
| 2008/0148928 | A1 | 6/2008 | McClellan |
| 2008/0156183 | A1 | 7/2008 | Brittingham |
| 2008/0271944 | A1 | 11/2008 | Brittingham |
| 2009/0050403 | A1 | 2/2009 | Brittingham |
| 2010/0281747 | A1 | 11/2010 | Anderson |
| 2010/0294118 | A1 | 11/2010 | Hortobagyi |
| 2010/0313743 | A1 | 12/2010 | Dueck et al. |
| 2011/0036233 | A1 | 2/2011 | Degroat |
| 2011/0056111 | A1 | 3/2011 | Brittingham |
| 2011/0056364 | A1 | 3/2011 | Kennedy et al. |
| 2011/0061966 | A1 | 3/2011 | Brittingham |
| 2012/0145478 | A1 | 6/2012 | Brittingham |

OTHER PUBLICATIONS

Paulson; AAC's Evolution-9, Suppressing hard-to-silence 9mm pistols including Beretta 92F; Special Weapons for Military and Police; cover and pp. 24-27; Fall 2002 issue; Harris Publications.

Paulson; ".223 Silencers: Where we've been, where we are, where we're going!"; Special Weapons; pp. 68-75; Aug. 2004.

Paulson; AAC Glock 9mm Suppressors, for GLOCK 17, 19, and 26 with AAC Evolution-9, Spider-2, Scorpion!; Combat Handguns; cover and pp. 34-39; Jun. 2006 issue; Harris Publications.

AAC Evolution-0 .9MM Shootout and Pistol Trials, Oct. 12, 2007 http://www.silencerresearch.com/9mm_shootout_and_pistol_trials.htm and http://web.archive.org/web/~/http://www.silencer-research.com/9mm_shootout_and_pistol_trials.htm and http//web.archive.org/web/200710121508481http://silencerresearch.com/9mm_shootout_and_pistol_t.

Multimount System. (2008) Retrieved from hup://www.gem-tech.com/MultiMount.html.

* cited by examiner

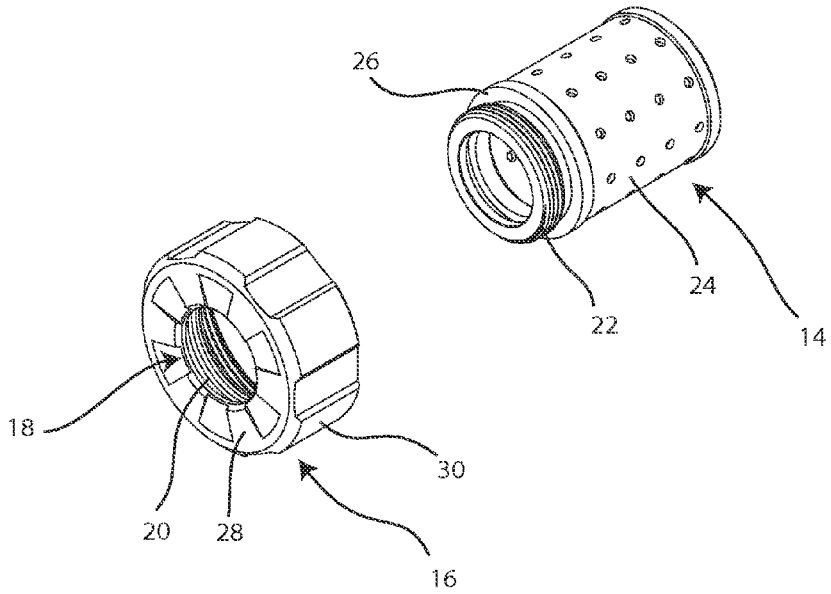
Fig. 2
Fig. 3
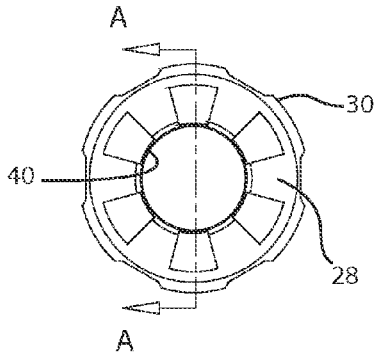
Fig. 4
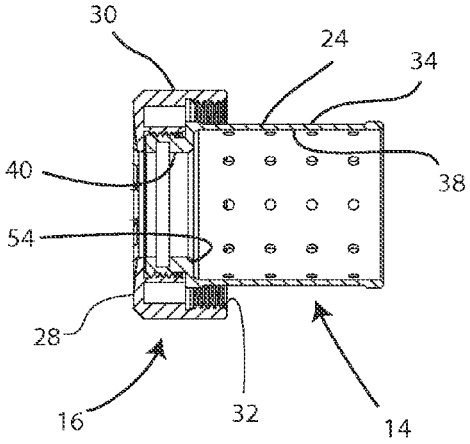

Fig. 5
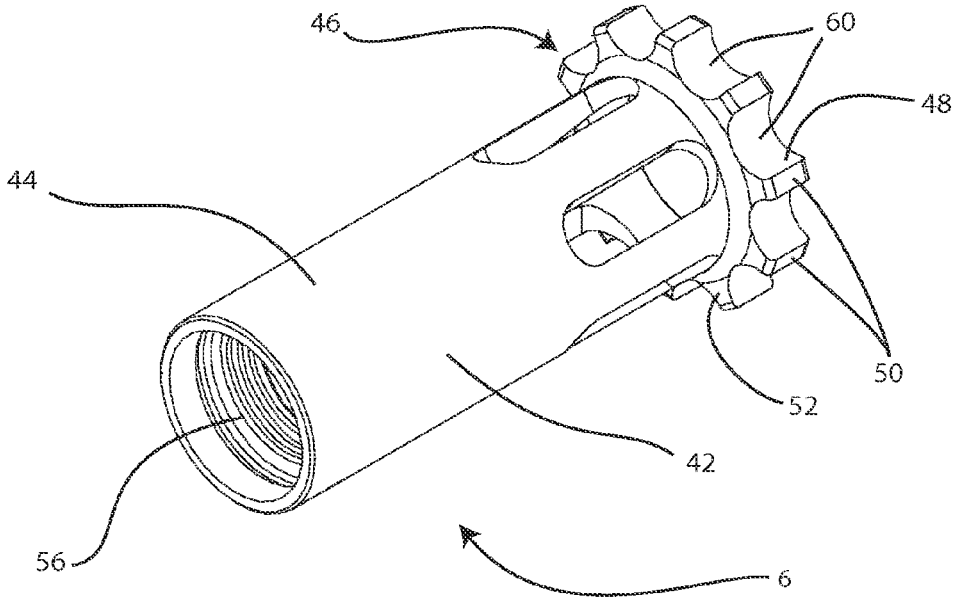
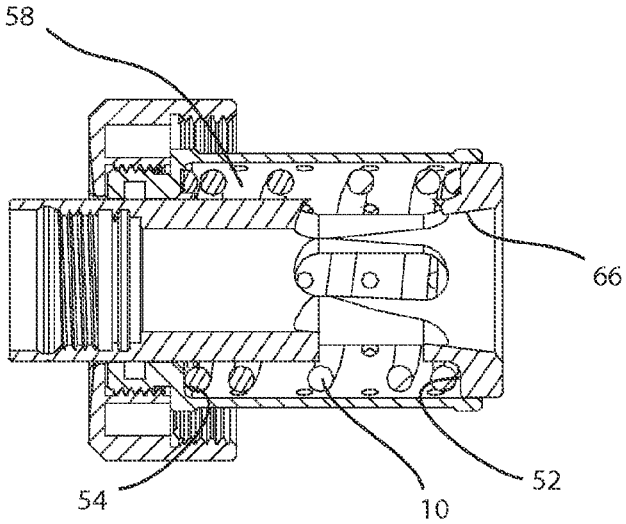
Fig. 6

FIREARM SUPPRESSOR BOOSTER SYSTEM

CROSS-REFERENCE TO RELATED APPLICATION

This application claims the benefit of and priority to U.S. Provisional Patent Application No. 61/274,738, filed Aug. 20, 2009, which is hereby incorporated by reference in its entirety.

FIELD

The present invention relates to firearm suppressors, and particularly relates to a booster system for a firearm suppressor or silencer.

BACKGROUND

Many semi-automatic handguns employ a short recoil action to feed a fresh cartridge into the chamber after firing. During the short recoil action the barrel and slide travel rearward a short distance together in a locked position until a mechanism causes the barrel to tilt downward. At this point the tilting barrel disengages from the slide which continues traveling rearward until it extracts the fired cartridge case and feeds a new cartridge into the chamber. A spring force causes the slide to return forward, the barrel to tilt up and reengage with the slide, and the locked barrel and slide to return to their original position. Thus, the firearm automatically reloads the chamber after firing such that the operator need only pull the trigger to fire a subsequent shot.

However, if a silencer or other muzzle device is attached to the front end of the barrel, the added weight can prevent the barrel from tilting downward after the initial small movement of the locked barrel and slide. Accordingly, if the barrel is unable to disengage from the slide, the slide is prevented from following its normal rearward path and recharging the chamber. Thus, the firearm will jam.

A booster system can be used to overcome the problem of the added weight on the front end of the barrel so that the barrel can tilt normally and allow the correct short recoil action. Fundamentally, the booster adds a spring between the weight of the silencer and the barrel of the firearm so that the barrel can tilt down normally and disengage with the slide. Aside from the term "booster" these types of systems are also referred to as, recoil regulators. Most booster systems include a piston that is slidably disposed in a piston housing such that the piston and piston housing can move with respect to another relative to the length of the barrel or silencer casing. For simplicity, any axis set forth in the following description will be with respect to the trajectory of a bullet or projectile fired by the firearm, unless otherwise indicated. Thus, the piston and piston housing of a booster system have relative movement along their respective axes. Typically, the piston is fixedly attached to the barrel of the firearm, while the piston housing is fixedly attached to the bulk of the silencer. Accordingly, the booster system allows relative movement between the barrel and the silencer based on the relative movement of the piston and piston housing.

To hold the silencer in its desired position with respect to the barrel of the firearm, a booster system typically includes a spring that biases the piston forward with respect to the piston housing. After firing, the barrel and piston begin to recoil backward while the expanding gases force the piston housing and silencer forward. As a result, the spring is compressed and the inertia of the piston housing and silencer "float" with respect to the piston and barrel. The "floating" condition of the piston housing and silencer allows the barrel to move backward, tilt down and disengage from the slide so that the chamber is recharged with a fresh cartridge. The spring of the booster system then ensures that the system is restored to its original position as it expands back to its former length.

Although booster systems help firearms with suppressors and short recoil actions fire reliably, they add to the overall length of the combined handgun and suppressor. The added length is typically seen as undesirable. Thus, booster systems with shorter lengths are highly advantageous.

SUMMARY OF THE INVENTION

In one embodiment, the present invention provides a booster system including a piston housing, a piston, a spring and a rear cap attached to the piston housing. The piston housing includes an annular outer wall and an annular projection extending radially inward from the outer wall at a rear end of the piston housing. The piston is disposed within the piston housing and includes a bore for the passing of a projectile from a firearm and a radially outwardly extending flange at its front end. The spring is radially disposed between the piston housing and the piston in an annular space enclosed at its front and rear ends by the outwardly extending flange and the annular projection, respectively. The rear cap includes an end wall extending radially outward from a rear end of the piston housing. A side wall extends forward from the end wall and hangs over the outer wall of the piston housing at a radial distance from the outer wall of the piston housing. The sidewall of the rear cap includes an engagement surface for attachment to a body of a silencer.

BRIEF DESCRIPTION OF THE DRAWINGS

The foregoing and other features of the present invention will be more readily apparent from the following detailed description and drawings of illustrative embodiments of the invention in which:

FIG. 2 shows a perspective exploded view of the piston housing assembly of FIG. 1;

FIG. 3 shows a rear view of the piston housing assembly of FIG. 2;

FIG. 4 shows a cross sectional view of the piston housing assembly along line A-A;

FIG. 5 shows a perspective view of the piston of FIG. 1;

FIG. 6 shows a cross section view of an assembly of the piston and piston housing assembly taken along a line similar to A-A;

DETAILED DESCRIPTION OF THE INVENTION

Figure 1:
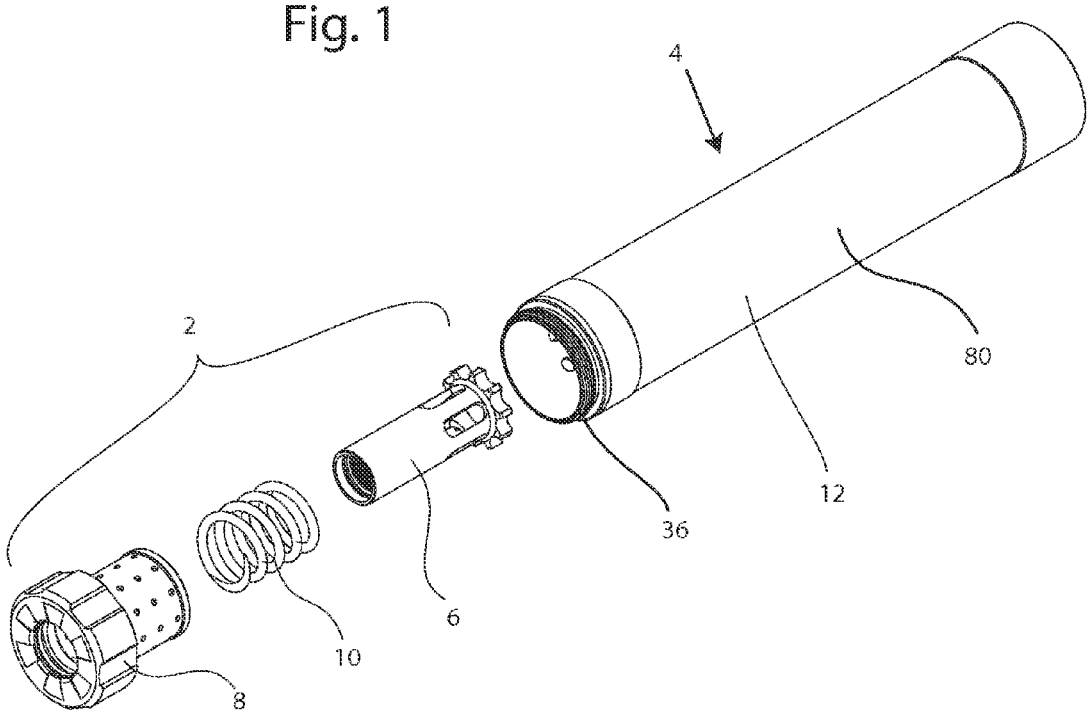
FIG. 1 shows a perspective exploded view of a booster system and silencer in accordance with an embodiment of the present invention.

As shown in FIG. 1, a booster system 2 in accordance with an embodiment of the present invention may be integrally incorporated with a firearm suppressor or silencer 4. The booster system 2 generally includes a piston 6, a piston housing assembly 8 and a spring 10. The piston 6 includes a first attachment for attaching to the barrel of a firearm, and the piston housing assembly 8 includes an attachment for attaching to a body 12 of the silencer 4. When assembled, the piston 6 is disposed within the piston housing 8, and the spring 10 provides a relative spring force between the piston 6 and piston housing 8 with the spring 10 urging the piston 6 forward and urging the piston housing 8 backward. When a projectile is fired from the firearm, it passes through a bore in the piston 6. The recoil of the firearm allows the piston 6 and barrel to move backward with respect to the piston housing assembly 8 and the rest of the silencer 4. As a result, the spring 10 is compressed. With the spring 10 compressed, the mass of the silencer 4 floats, and the barrel of the firearm is able to tilt downward resulting in a normal short recoil action.

The piston housing assembly 8 is configured as an assembly of the piston housing 14 and the rear cap 16 of the silencer 4, as shown in FIGS. 2-4. The rear cap 16 includes an inner bore 18 with an attachment device 20 for securing the rear cap 16 to a corresponding attachment device 22 of the piston housing 14. A central axis of the inner bore 18 of the rear cap 16 is coaxial with a central axis of the piston housing 14. The shown attachment device 20 is formed as inner housing threads 20 configured as female threads, and shown attachment device 22 is formed as piston housing threads 22 configured as male threads. This configuration allows the piston housing 14 to be manufactured separately from the rear cap 16 and subsequently threaded together. As shown, the piston housing threads 22 may have a smaller radius than an outer wall 24 of piston housing 14. This difference in radius allows piston housing 14 to include a shoulder 26 which limits the amount that piston housing 14 can be inserted into rear cap 16. Accordingly, the rear cap 16 cannot be screwed too far onto piston housing 14 as it is stopped by shoulder 26. Alternatively, the piston housing threads 22 may be the same or a greater diameter than the outer wall 24 of piston housing threads 22. The inner housing threads 20 of the rear cap 16 can be permanently or semi-permanently fixed to the piston housing threads 22 using an adhesive when the piston housing 14 and rear cap 16 are assembled.

The rear cap 16 includes an end wall 28 and a circumferential sidewall 30. The outer surface of each of the end wall 28 and sidewall 30 can be textured, as shown. The texture may aid the user when disengaging the rear cap 16 from the silencer body 12. The sidewall 30 extends forward from the end wall 28 projecting over the outer surface 34 of the piston housing 14. In one example, the sidewall 30 can be coaxial with the piston housing and disposed radially outward of the piston housing 14. The sidewall 30 includes an engagement surface 32 for attaching to the body 12 of the silencer 4. In the illustrated embodiment, the engagement surface 32 is on the inside of sidewall 30 and is configured as female rear cap threads 32. The rear cap threads 32 overlap with the outer wall 24 of the piston housing 22 and have a larger radius than the outer surface 34 of the outer wall 24 of the piston housing 22. The engagement surface 32 of the rear cap 16 is configured to engage with a corresponding engagement surface 36 of the silencer body 12, as illustrated in FIG. 1.

The piston housing 14 is configured to hold the piston 6 therein and includes an inner sliding surface 40 that engages with an outer sliding surface 44 of the piston 6 (shown in FIG. 5). In the illustrated embodiment, the inner sliding surface 40 is disposed at the rear end of the piston housing 14 adjacent the rear cap 16. The inner sliding surface 40 of the piston housing 14 is substantially equivalent in diameter to the outer sliding surface 42 of the piston 6. However, the outer sliding surface 44 of the piston 6 has a slightly smaller diameter so that it can fit within the piston housing 14 and slide forward and backward relatively easily. On the other hand, the outer sliding surface 44 of the piston 6 and inner sliding surface 40 of the piston housing 14 are both substantially smaller than the inner surface 38 of the outer wall 24 of the piston housing 14. Thus, an annular space 58 exists between the body 42 of the piston 6 and the outer wall 24 of the piston housing 14 when the piston 6 is disposed within the piston housing 14, as shown in FIG. 6.

At the front end of the piston 6, an annular flange 46 may extend radially outward from the body 42 of the piston. In the illustrated embodiment, the annular flange 46 is made up of a plurality of spokes 48 extending out from the body 42 of the piston. Each spoke 48 includes an outer tip 50, which is discussed in more detail below. The outer tips 50 may collectively form a disjointed surface that slides against the inner surface 38 of the outer wall 24 of the piston housing. In one embodiment, the spokes 48 are separated by evenly spaced vents 60.

When the piston 6 is disposed within the piston housing 14, as shown in FIG. 6, the annular space 58 between the outer sliding surface 44 of the piston and the inner surface 38 of outer wall 24 is enclosed at its front and rear ends by shoulders 52 and 54, respectively. Front shoulder 52 is formed by the rear facing wall of the annular flange 46 of the piston 6. Rear shoulder 54 is formed by the front-facing annular projection of the piston housing 14 where the radius of the housing increases from the inner sliding surface 40 to the outer wall 34, as shown in FIG. 4. The front and rear shoulders 52, 54 are configured to support spring 10, which is disposed in the annular space between the piston 6 and the piston housing 14 when the booster is assembled.

As stated above, the rear end of the piston 6 includes a first attachment 56 for attaching to the barrel of a firearm. In the illustrated embodiment, the attachment 56 is formed as barrel threads 56 for threading the barrel of the firearm to the piston. When the firearm is fired, the barrel and piston 6 move rearward with respect to the piston housing 14 and silencer 4. Thus, the spring 10 disposed within the annular space between the piston 6 and piston housing 14 is compressed as the front shoulder 52 moves toward the rear shoulder 54. After the projectile is fired and the gases begin to cool, the spring 10 expands again and brings the silencer 4 back to its original position with respect to the barrel of the firearm.

Figure 7:
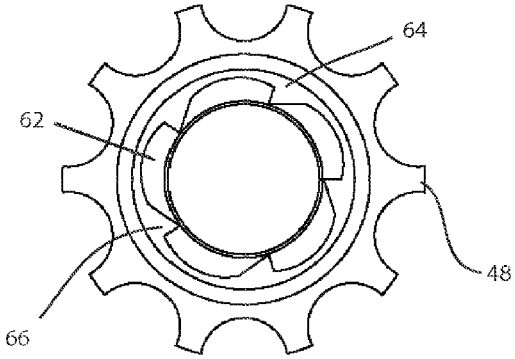
FIG. 7 shows a front view of the piston of FIG. 5.

The piston 6 includes openings in the form of slots 62 that allow gases to expand into an axial chamber provided by the annular space 58 disposed between the piston 6 and the piston housing 14. This axial chamber 58 absorbs energy as the gases expand such that the booster system aids in sound suppression. The slots 62 can be elongate along the axis of the piston 6 and disposed evenly around the circumference of the piston 6 at its front end. In one embodiment, the front side of each slot 62 is adjacent to the front shoulder 52. In the illustrated embodiment, the edge of the slots 62 at the outer surface 44 of the piston 6 run straight with respect to the axis of the piston 6. In contrast, the edge of each slot 62 on the inner surface 64 of the piston 6 can curve in a helical manner from the rear end of the piston to the front end, as best shown in FIG. 7. In this configuration, the inner and outer edges of the slots 62 are radially aligned at the front end of the piston, but toward the rear end of the piston 6 the inner edges of the slots 62 are disposed at an angle with respect to the radius of the piston from the outer edges of the slots 62. Further, a portion of the inner surface 64 of the piston can taper radially outward along the axial length of the piston from the rear end to the front end. A section of this tapered portion 66 is shown in FIG. 6 and can be seen from the front view of the piston in FIG. 7.

Figure 8:
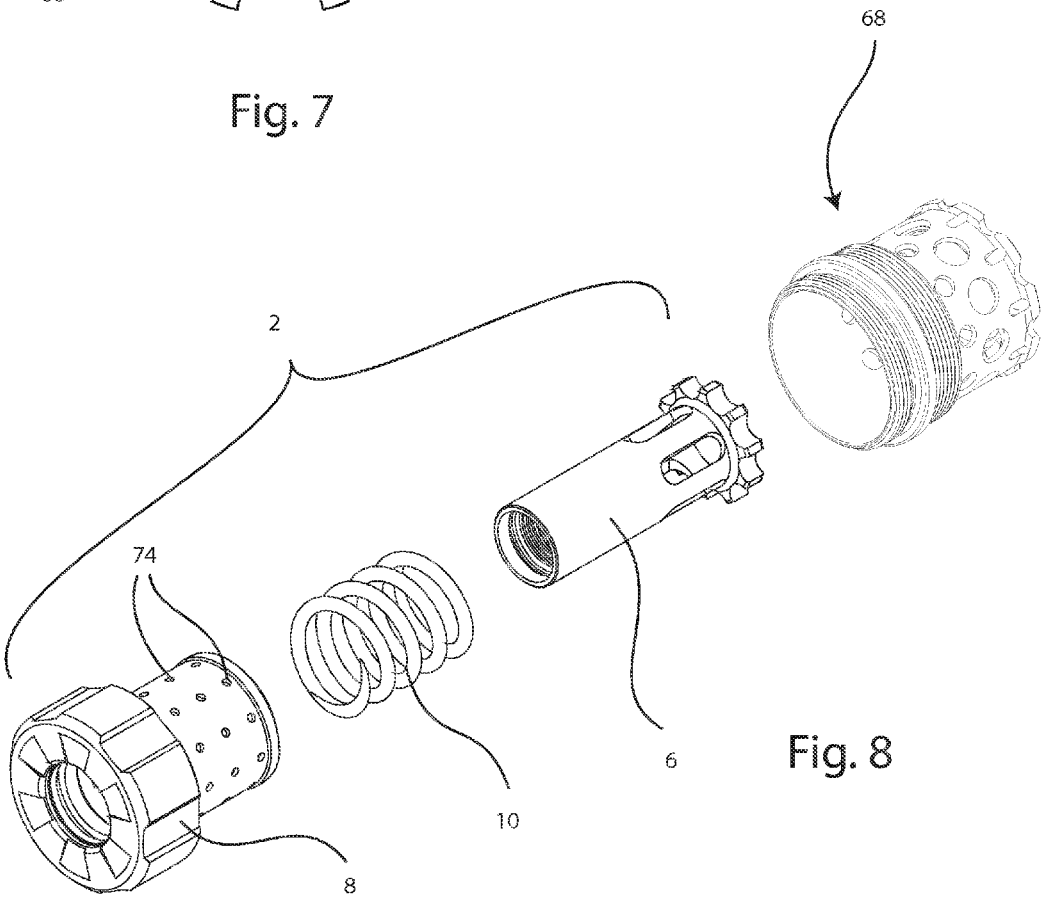
FIG. 8 shows a perspective exploded view of the booster system and an interface of FIG. 1.
Figure 9:
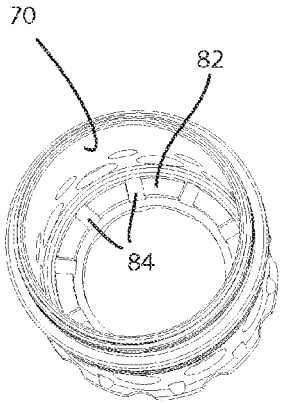
FIG. 9 shows a rear perspective view of the interface of FIG. 8.
Figure 10:
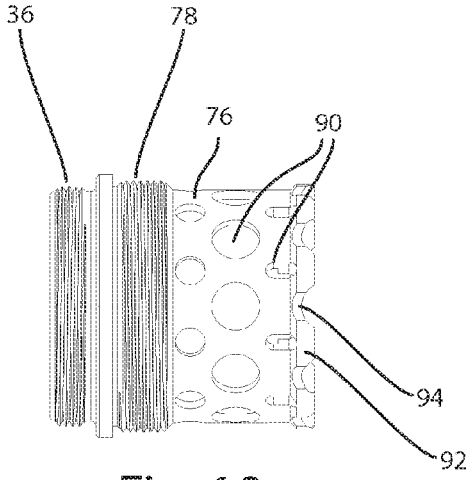
FIG. 10 shows a side view of the interface of FIG. 8.
Figure 11:
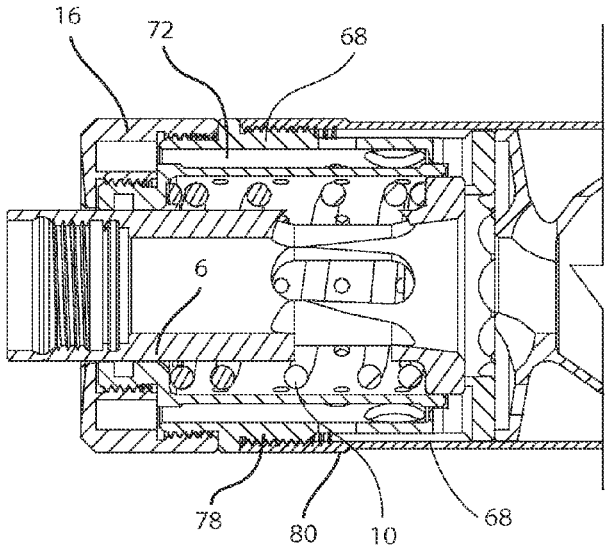
FIG. 11 shows a cross section view of an assembly of the booster system and silencer of FIG. 1 taken along a line similar to A-A.

In a preferred embodiment, the booster system 2 is attached to the body of the silencer 12 at an interface 68, which is shown in FIG. 8 in an exploded view along with the piston 6, piston housing assembly 8, and spring 10. Additional details of the interface 68 are shown in FIGS. 9-11. The interface 68 includes engagement surface 36 for attaching to corresponding engagement surface 32 of the piston housing assembly 8. As illustrated, the engagement surface 36 can be disposed on the rear end of the interface 68 and can be in the form of male threads. When the threads of engagement surfaces 32 and 36 are engaged, the front end of interface 68 is disposed between the side wall 30 of rear cap 16 and the outer wall 24 of piston housing 14. The interface 68 extends forward from the rear cap 16 and radially surrounds the piston housing 14 in axially alignment therewith.

The inner side 70 of interface 68 can be larger in diameter than the outer wall 24 of piston housing 14. The resulting gap between the inner side 70 of the interface and the outer wall 24 of piston housing 14 provides a coaxial chamber 72 allowing for gases to expand and aiding in sound suppression. The gases flow from the axial chamber 58 and the coaxial chamber 72 through a series of openings 74 in the piston housing (shown in FIG. 8). In the illustrated embodiment, the piston housing 14 includes four rows of openings 74 along its axial length disposed evenly around the circumference of the piston housing 14.

The outer side 76 of the interface 68 also includes a second engagement surface 78 just forward from engagement surface 36. The second engagement surface 78 is configured to attach to the outer casing 80 of the silencer body 12. From the second engagement surface 78, the interface extends forward to cover the entire length of the booster system including the front end of the piston housing 14 and the piston 6. The front end of the interface 68 terminates with an annular inner-facing projection 82 against which the annular flange 46 of piston 6 abuts. Accordingly, forward motion of the piston 6 is limited by the interface 68 due to the inner-facing projection 82. When the booster system is at rest, the piston 6 is radially locked within the interface 68 by a series of channels 84 around the circumference of the projection 82 which each seat a respective spoke 48 at its outer tip 50. Thus, when the spring 10 is at its maximum length, the outer tips 50 of spokes 48 are disposed within the channels 84 and thereby prevent rotation of the piston 6. However, if desired, the silencer casing (and attached interface 68) can be pulled forward compressing the spring 10 so as to disengage the spokes 48 from the channels 84 allowing the silencer to be turned. These features are described in greater detail in U.S. patent application Ser. No. 12/221,715, which is incorporated by reference herein.

Along the axis of the interface 68 between the second engagement surface 78 and projection 82, the outer side 76 includes a recess 86 extending along the axis and around the circumference of the interface 68. The recess 86 is recessed inward from the outer side 76 of the interface 68 and provides an annular gap 88 between the interface 68 and outer casing 80 of the silencer. This annular gap 88 provides a tri-axial chamber 88 for the expansion of gases in the vicinity of the booster system. The tri-axial chamber 88 is accessible from the coaxial chamber 72 through holes 90 in the recessed portion of the interface 68. The holes 90 can be arranged in rows of varying size and shape along the length of the axis of the interface. Each row may contain the same number of holes, as shown, or the number of holes may differ from row to row. In the illustrated embodiment, the number of holes 90 in each row of the interface is the same as the number of openings in the piston housing 14. The holes can be radially aligned or can be staggered, as shown. At the front end of the interface 68 where recess 86 ends, the end portion 92, which abuts outer casing 80, can have grooves 94 disposed around its circumference to allow expanding gases to travel from the tri-axial chamber into the remainder of the silencer.

While the invention has been particularly shown and described with reference to preferred embodiments thereof, it will be understood by those skilled in the art that various changes in form and details may be made therein without departing from the spirit and scope of the invention.

We claim:

1. A booster system for a firearm suppressor comprising:

a piston housing including an annular outer wall and an annular projection extending radially inward from the outer wall at a rear end of the piston housing, the annular projection forming a front-facing shoulder;

a piston disposed within the piston housing and including a bore for the passing of a projectile from a firearm and a radially outwardly extending flange at a front end thereof, the flange forming a rear-facing shoulder;

a spring radially disposed in an annular space between the piston housing and the piston, the spring engaging the front-facing and rear-facing shoulders; and a rear cap including:

an end wall extending radially outward from a rear end of the piston housing, and an annular side wall extending forward from the end wall over the outer wall of the piston housing and at a radial distance from the outer wall of the piston housing, the sidewall including an engagement surface configured for attachment to a body of the suppressor.

2. The booster system of claim 1 wherein the end wall of the rear cap is fixedly attached to the rear end of the piston housing.

3. The booster system of claim 1 wherein the attachment surface is disposed on a radially inner side of the side wall.

4. The booster system of claim 3 wherein the attachment surface includes female threads.

5. The booster system of claim 1 wherein the piston includes at least one first opening extending from the bore to the annular space such that the annular space forms an axial chamber, and wherein the outer wall of the piston housing includes at least one second opening extending from the axial chamber to a coaxial chamber disposed around the piston housing and adjacent an outer surface of the piston housing outer wall.

6. The booster system of claim 1 wherein the piston housing extends further forward than the annular side wall of the rear cap.

7. A booster system for a firearm suppressor comprising:

a piston housing including an annular outer wall and an annular projection extending radially inward from the outer wall at a rear end of the piston housing, the annular projection forming a front-facing shoulder;

a piston disposed within the piston housing and including a bore for the passing of a projectile from a firearm and a radially outwardly extending flange at a front end thereof, the flange forming a rear-facing shoulder;

a spring radially disposed in an annular space between the piston housing and the piston, the spring engaging the front-facing and rear-facing shoulders;

a rear cap including:

an end wall extending radially outward from a rear end of the piston housing, and an annular side wall extending forward from the end wall over the outer wall of the piston housing and at a radial distance from the outer wall of the piston housing, the sidewall including a first cap engagement surface; and an interface disposed around the piston housing and including:

a second cap engagement surface disposed at a rear end of the interface and engaged with the first cap engagement surface of the rear cap, and a casing engagement surface configured to engage with an outer casing of the suppressor.

8. The booster system of claim 7 wherein the end wall of the rear cap is fixedly attached to the rear end of the piston housing.

9. The booster system of claim 7 wherein the attachment surface is disposed on a radially inner side of the side wall.

10. The booster system of claim 9 wherein the attachment surface includes female threads.

11. The booster system of claim 7 wherein the interface extends further forward than the piston housing, wherein the piston includes at least one first opening extending from the bore to the annular space such that the annular space forms an axial chamber, wherein the outer wall of the piston housing includes at least one second opening extending from the axial chamber to a coaxial chamber disposed between an outer surface of the piston housing outer wall and the interface, and wherein the interface includes at least one third opening extending from the coaxial chamber to a tri-axial chamber disposed around the interface and adjacent an outer surface of the interface.

12. The booster system of claim 7 wherein the piston housing extends further forward than the annular side wall of the rear cap and the interface extends further forward than the piston housing.

13. A booster system for a firearm suppressor comprising:

a piston housing including an annular outer wall and an annular projection extending radially inward from the outer wall at a rear end of the piston housing, the annular projection forming a front-facing shoulder;

a piston disposed within the piston housing and including a bore for the passing of a projectile from a firearm and a radially outwardly extending flange at a front end thereof, the flange forming a rear-facing shoulder;

a spring radially disposed in an annular space between the piston housing and the piston, the spring engaging the front-facing and rear-facing shoulders;

a rear cap including:

an end wall extending radially outward from a rear end of the piston housing, and an annular side wall extending forward from the end wall over the outer wall of the piston housing and at a radial distance from the outer wall of the piston housing, the sidewall including a first cap engagement surface; and an interface disposed around the piston housing and including:

a second cap engagement surface disposed at a rear end of the interface and engaged with the first cap engagement surface of the rear cap, and a first casing engagement surface disposed on an outer surface of the interface forward from the second cap engagement surface; and an outer casing including a second casing engagement engaged with the first casing engagement of the of the interface.

14. The booster system of claim 13 wherein the end wall of the rear cap is fixedly attached to the rear end of the piston housing.

15. The booster system of claim 13 wherein the attachment surface is disposed on a radially inner side of the side wall.

16. The booster system of claim 15 wherein the attachment surface includes female threads.

17. The booster system of claim 13 wherein the interface extends further forward than the piston housing, wherein the piston includes at least one first opening extending from the bore to the annular space such that the annular space forms an axial chamber, wherein the outer wall of the piston housing includes at least one second opening extending from the axial chamber to a coaxial chamber disposed between an outer surface of the piston housing outer wall and the interface, and wherein the interface includes at least one third opening extending from the coaxial chamber to a tri-axial chamber disposed between the interface and the casing.

18. The booster system of claim 13 wherein the piston housing extends further forward than the annular side wall of the rear cap and the interface extends further forward than the piston housing.

* * * * *